United States Patent [19]

Hashimoto et al.

[11] Patent Number: 4,575,271

[45] Date of Patent: Mar. 11, 1986

[54] WRITING INSTRUMENT WITH MOVABLE CLOSURE AND SECOND SEALING MEANS

[75] Inventors: Yasuyuki Hashimoto, Hyogo; Kazuo Shimizu, Osaka, both of Japan

[73] Assignee: Ancos Co., Ltd., Osaka, Japan

[21] Appl. No.: 529,771

[22] Filed: Sep. 6, 1983

[30] Foreign Application Priority Data

| | | | |
|---|---|---|---|
| Sep. 4, 1982 | [JP] | Japan | 57-133783[U] |
| Dec. 29, 1982 | [JP] | Japan | 57-233143 |
| May 12, 1983 | [JP] | Japan | 58-81798 |

[51] Int. Cl.[4] ..... B43K 9/00; B43K 7/12; B43K 8/02

[52] U.S. Cl. ..... 401/107; 401/108

[58] Field of Search ..... 401/107, 108, 54

[56] References Cited

U.S. PATENT DOCUMENTS

| | | | |
|---|---|---|---|
| 497,873 | 5/1893 | Hagenmeyer | 401/54 |
| 1,063,134 | 5/1913 | Norris | 401/107 X |
| 3,292,593 | 12/1966 | Furuya | 401/107 |
| 3,362,778 | 1/1968 | Pauese | 401/107 |
| 3,525,573 | 8/1970 | Fend | 401/108 |

FOREIGN PATENT DOCUMENTS

| | | | |
|---|---|---|---|
| 2451273 | 11/1980 | France | 401/99 |
| 443588 | 12/1948 | Italy | 401/107 |
| 469200 | 2/1952 | Italy | 401/108 |
| 566613 | 9/1957 | Italy | 401/107 |

*Primary Examiner*—Steven A. Bratlie
*Attorney, Agent, or Firm*—Sughrue, Mion, Zinn, Macpeak & Seas

[57] ABSTRACT

A writing instrument comprises, an outer barrel unit (1); a slidable tube (27) housed in the outer barrel unit (1) and movable between a sealing position and an advanced position; an inner tube (16) housed in the slidable tube (27), the inner tube (16) having an opening (18) defined in a distal end thereof and being associated with the barrel unit (1); a writing unit (10) disposed in the inner tube (16) and having a writing tip (14) on a distal end thereof, the writing unit being axially movable among a retracted position, a writing position and a projected position; a first spring for biasing said writing unit rearwardly; a second spring for biasing the slidable unit rearwardly; a first sealing member for sealing said opening (18) of the inner tube (16), the first sealing member being pressable by an inner surface of a front end of the slidable tube (27) against the opening (18) of the inner tube (16) when the slidable tube (27) is in the sealing position; a second sealing member for sealing the writing tip (14) of the writing unit (10) together with the first sealing member, the second sealing member being located between the writing unit (10) and the inner tube (16); and a retaining means for retaining the writing unit (10) at the retracted position and the writing position.

21 Claims, 45 Drawing Figures

WRITING INSTRUMENT WITH MOVABLE CLOSURE AND SECOND SEALING MEANS

BACKGROUND OF THE INVENTION

The present invention is applicable to a variety of writing instruments such as a fountain pen, a fabric-tip pen, a ball-point pen or the like, but is especially most effective when incroporated in writing instruments such as a fabric-tip pen and a water-ink ball-point pen.

The applicant has already filed applications on various writing instruments in which a seal cap or seal ball is movable into and out of a sealing position in response to a knocking or turning motion for sealing a writing tip or unsealing the same in readiness for writing as disclosed by U.S. patent application Ser. No. 394,987 filed on July 2, 1982 now U.S. Pat. No. 4,469,462 by the present applicants and U.S. patent application No. 394,957 filed on July 2, 1982 now by U.S. Pat. No. 4,479,732 by the present applicants. These prior writing instruments have an air vent hole defined in the vicinity of a tip end portion of a cartridge to seal the writing tip near the tip end portion. The structural limitation prevents such prior arrangements from being incorporated in writing members or ink cartridges generally available on the market or those with small modifications. Therefore, the prior inventions have required ink cartridges to be constructed as a whole with special design.

SUMMARY OF THE INVENTION

It is an object of the present invention to provide a writing instrument which can be constructed by utilizing a commercially available writing member or ink cartridge or such an existing writing member with a small modification.

According to the present invention, there is provided a writing instrument comprising, an outer barrel unit; a slidable tube housed in said outer barrel and movable between a sealing position and an advanced position; an inner tube housed in said slidable tube, said inner tube having an opening defined in a distal end thereof and being associated with said barrel unit; a writing unit disposed in said inner tube and having a writing tip on a distal end thereof, said writing unit being axially movable among a retracted position, a writing position and a projected position; a first means for biasing said writing unit in one direction; a second means for biasing said slidable unit in said one direction; a first sealing means for sealing said opening of said inner tube, said first sealing means being pressable by an inner surface of a front end of said slidable tube against said opening of said inner tube when said slidable tube is in said sealing position;

a second sealing means for sealing said writing tip of said writing unit together with said first sealing means, said second sealing means being located between said writing unit and said inner tube; and a retaining means for retaining said writing unit at said retracted position and said writing position.

BRIEF DESCRIPTION OF THE INVENTION

DETAILED DESCRIPTION OF THE PREFERRED EMBODIMENTS

The present invention will now be described with reference to the drawings.

Figures 1, 4, 5, 6:
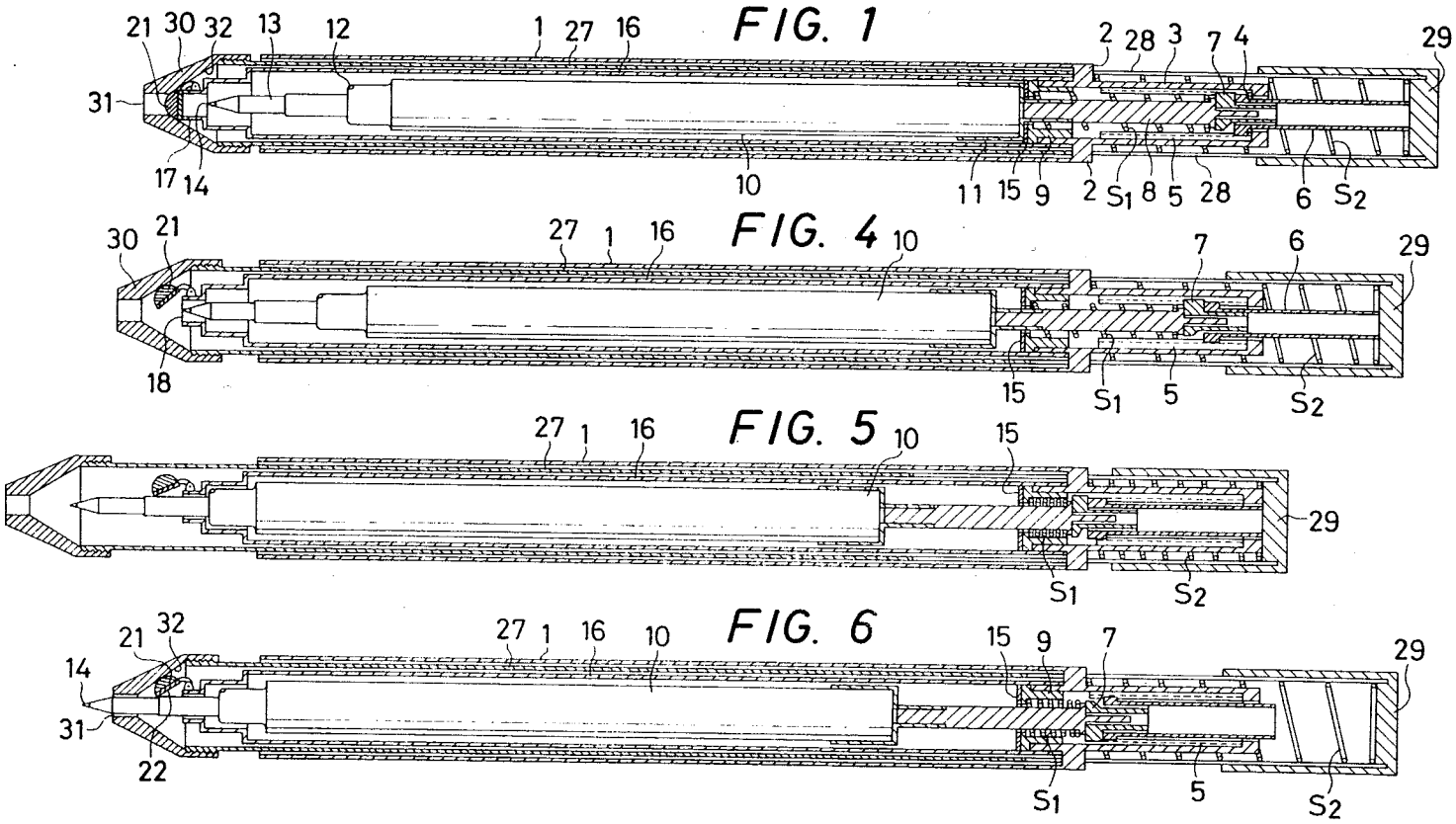
FIGS. 1, 4, 5 and 6 are cross sectional view of a writing instrument according to a first embodiment of the present invention, the views showing steps of operation.

FIG. 1 shows in cross section a writing instrument according to a first embodiment of the present invention. A cylindrical barrel or casing 1 has on a rear end thereof a pair of diametrically opposite legs 2, 2 extending radially inwardly toward an axial center of the barrel 1. The legs 2, 2 have inner ends formed integrally with an outer periphery of a cylinder 3 adjacent to a front end thereof. The cylinder 3 has a rear end including a radially inwardly extending edge which provide a step 4. The cylinder 3 also has a cam wall 5 on an inner peripheral surface thereof, the cam wall 5 having axial groove and oblique locking edges at a front end thereof. The barrel 1, the legs 2, 2, and the cylinder 3 are integrally molded, but may be separately molded and then assembled together as by adhesive bonding.

A cylinderical pusher rod 6 is fitted in the cylinder 3 and has a front end of a larger diameter engageable with the step 4 of the cylinder 3 to prevent the pusher rod 6 from being pulled rearwardly out of the cylinder 3. The larger front end of the pusher rod 6 has ridges fitted respectively in the axial grooves in the cam wall 5. The pusher rod 6 has an oblique front surface. The substantial portion of the pusher rod 6 normally projects rearwardly through the rear opening in the cylinder 3. A rotary cam 7 is disposed in a front end portion of the pusher rod 6 and has on an outer periphery thereof ridges fitted respectively in the grooves in the cam wall 5. The rotary cam 7 has an oblique rear surface and a central hole. A rod 8 is positioned in front of the rotary cam 7 and has a rear end portion fitted in the central hole in the rotary cam 7. Thus, the rod 8 and the rotary cam 7 are coupled to each other. A bushing 9 is fitted in the cylinder 3 at a front end portion thereof. The rod 8, the rotary cam 7 and the pusher rod 6 are normally urged toward a rear position under the force of a spring $S_1$ disposed between the bushing 9 and a rear flange of the rod 8.

A separate writing member 10 such as an ink cartridge is housed in the barrel 1. A connector 11 has a front larger-diameter cylindrical portion and a rear smaller-diameter cylindrical portion. The ink cartridge 10 has a rear end portion removably fitted in the front larger-diameter cylindrical portion of the connector 11, and a rear end portion fixedly fitted over a front end portion of the rod 8. Accordingly, the ink cartridge 10 is positioned in front of and coupled to the rod 8. The ink cartridge 10 has a front air vent hole 12 and a smaller-diameter front end portion 13 having a writing tip 14 on its front end. A packing 15 is attached to a front end surface of the bushing 9 and has an outer peripheral edge dimensioned to be resiliently pressed against an inner peripheral surface of an inner cylindrical tube 16.

Figure 2:
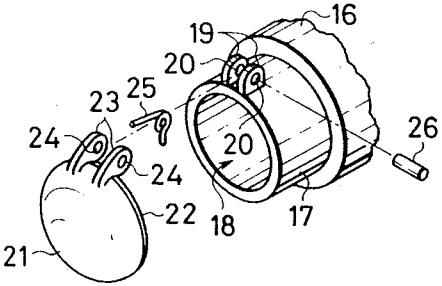
FIG. 2 is a fragmentary exploded perspective view of the writing instrument of the first embodiment.
Figure 3:
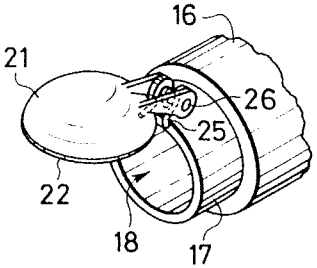
FIG. 3 is a perspective view of the assembled parts shown in FIG. 2.

The inner cylindrical tube 16 is housed in the barrel 1 and accommodates therein the ink cartridge 10. The inner tube 16 has a rear end detachably fitted over the front end portion of the cylinder 3, and a smaller-diameter front end portion 17 having a distal opening 18. As shown in FIG. 2, the smaller-diameter front end portion 17 has a pair of lugs 19, 19 with small apertures 20, 20 formed respectively therein. A substantially disk-shaped sealing body 21 is pivotably attached to the front end portion 17 and has a size large enough to close the opening 18. More specifically, the sealing body 21 has a rounded front surface with a sealing member 22 attached to a rear surface thereof. The sealing body 21 has a pair of lugs 23, 23 having respective small apertures 24, 24. For assembly, a spring 25 is placed between the lugs 19, 19, and the lugs 19, 19 are sandwiched between the lugs 23, 23, followed by insertion of a pin 26 through the small apertures 20, 20, 24, 24 and a hole in the spring 25. The sealing body 21 is now pivotably mounted on the distal end of the inner tube 16 as shown in FIG. 3. The sealing body 21 is normally urged by a small force of the spring 25 in a direction to open away from the opening 18. The sealing body 21 can be angularly moved in against the force of the spring 25 into abutment against the inner tube 16, thereby closing and sealing the opening 18 in the inner tube 16. A spring or a magnet may be employed to normally bias the sealing body 21 to close and seal the opening 18 in the inner tube 16 as described later.

A cylindrical slidable tube 27 is also housed in the barrel 1 and fitted over the inner tube 16. The slidable tube 27 has a pair of diametrically opposite slits 28, 28 defined in a rear end portion thereof. For assembly, the slidable tube 27 is inserted in a rearward direction between the barrel 1 and the inner tube 16 until the rear end portion of the slidable tube 27 projects rearward through the rear opening of the barrel 1 with the legs 2, 2 disposed respectively in the slits 28, 28. A push cap 29 is then fitted over the rear end portion of the slidable tube 27 with a spring $S_2$ placed between the legs 2, 2 and a bottom of the push cap 29. In the embodiment shown in FIG. 1, a small space is provided between the rear end of the pusher rod 6 and an inner bottom surface of the push cap 29. The spring $S_2$ normally urges the slidable tube 27 in a rearward direction away from the barrel 1. Thereafter, a conical front cap 30 is threaded over a front end of the slidable tube 27. The writing instrument is thus assembled as illustrated in FIG. 1. The conical front cap 30 is tapered with a distal opening 31 defined in a front end thereof and has a conical inner surface 32.

FIG. 1 shows the writing instrument as placed in a sealed condition. More specifically, the slidable tube 27 is retracted under the bias of the spring $S_2$ to enable the conical inner surface 32 in the conical front cap 30 to push the sealing body 21 backward until it closes and seals the opening 18 in the inner tube 16. Where the sealing body 21 is normally biased by the spring or magnet to close the opening 18, the sealing body 21 may not necessarily be pushed backward by the conical inner surface 32. With the packing 15 providing a seal between the rear end portion of the inner tube 16 and the rear end of the ink cartridge 10, the writing tip 14 and the air vent hole 12 of the ink cartridge 10 are sealed from the exterior. At this time, the pusher rod 6 is displaced rearward and the rotary cam 7 is in the rear position on the cam wall 5.

To actuate the writing instrument from the sealed condition into an unsealed condition in readiness for writing, the push cap 29 is pushed to move the slidable tube 27 and hence the front conical cap 30 while compressing the spring $S_2$ after the cap 29 is advanced by a short distance between the rear end of the pusher rod 6 and the bottom surface of the cap 29. As the front conical cap 30 moves forwardly, the sealing body 21 is angularly moved under the resiliency of the spring 25 to uncover the opening 18 in the inner tube 16. At the same time, depression of the push cap 29 causes the pusher rod 6, the rotary cam 7 and the rod 8 to move the ink cartridge 10 in a forward direction through the position shown in FIG. 4 to the position of FIG. 5, in which the small-diameter front end portion 13 of the ink cartridge 10 projects through the opening 18. At this time, the rotary cam 7 is positioned slightly ahead of the front edge of the cam wall 5 with the spring $S_1$ kept under compression. When the push cap 29 is released in the position of FIG. 5, the slidable tube 27 is moved back under the force of the spring $S_2$. At this time, the rotary cam 7 is also moved back as it slightly turns into engagement with the front edge of the cam wall 5, thus preventing the ink cartridge 10 from being moved back. The tip end portion of the ink cartridge 10 now remains projecting through the opening 31 in the conical front piece 30 as illustrated in FIG. 6. The writing instrument is now in the writing porition.

For bringing the writing instrument from the writing position back to the sealed position, the push cap 29 is pushed again in the position of FIG. 6. The push cap 29 is moved forward to cause the pusher rod 6 to move the rotary cam 7 slightly forward. When the push cap 29 is released at such time as the rotary cam 7 is slightly shifted off the front edge of the cam wall 5 as shown in FIG. 5, the rotary cam 7 is slightly turned and then moved back along the cam wall 5 under the force of the spring $S_1$. The ink cartridge 10 is also moved back until the rear end thereof abuts against the packing 15 attached to the front end of the bushing 9. At this time, the ink cartridge 10 is bodily stored in the inner tube 16. Simultaneously, the slidable tube 27 returns under the force of the spring $S_2$ and so does the conical front cap 30 with its conical inner surface 32 pushing the sealing body 21 into engagement with the distal end of the inner tube 16, thereby closing and sealing the opening 18. The writing instrument is now in the sealed condition.

Figure 7:
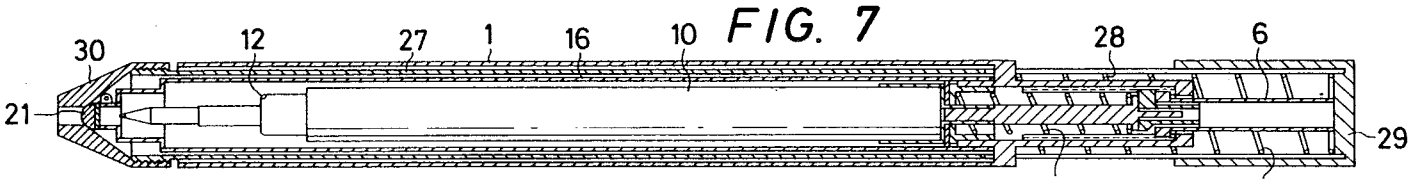
FIG. 7 is a cross-sectional view of a second embodiment.

A writing instrument according to a second embodiment will be described with reference to FIG. 7. According to the second embodiment shown in FIG. 7 in which the same reference numerals are used to designate the same components shown in FIGS. 1 to 6, the slidable tube 27 and the ink cartridge 10 move forward at the same time in response to the push cap 29 being pushed. With the first embodiment, the rear end of the pusher rod 6 is slightly spaced from the bottom of the push cap 29 in the sealed condition. When the push cap 29 is pushed, the slidable tube 27 is first moved forwardly, and after the push cap 29 hits the rear end of the pusher rod 6, the ink cartridge 10 is moved forwardly. The writing instrument of the second embodiment can operate in substantially the same manner as that of the writing instrument of the first embodiment. According to the first embodiment, the ink cartridge 10 can be positioned relatively forward of the ink cartridge 10 of the second embodiment by the distance equal to the spacing between the rear end of pusher rod 6 and the bottom of the push cap 29.

Figure 8:
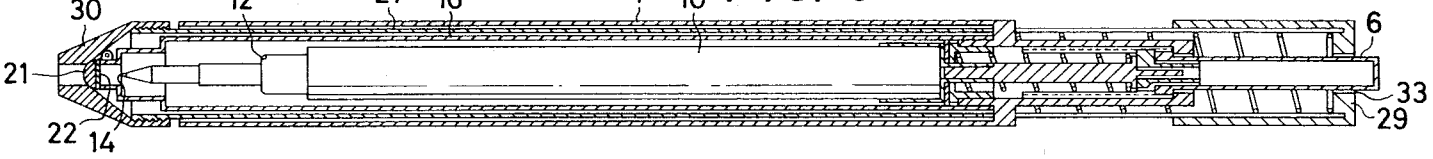
FIG. 8 is a cross-sectional view of a third embodiment.

FIG. 8 illustrates a writing instrument according to a third embodiment of the invention. The push cap 29 has a central through hole 33. The pusher rod 6, which is longer than the pusher rods according to the first and second embodiments, projects rearward through the hole 33 in the push cap 29 in the sealed condition. In the sealed condition, the tip end of the ink cartridge 10 is spaced from the sealing member 22 by a distance greater than the length of the pusher rod 6 which projects rearward beyond the bottom of the push cap 29. For bringing the writing instrument from the sealed position to the writing position, the pusher rod 6 is pushed to move the ink cartridge 10 at first. After the rear end of the pusher rod 6 lies flush with the rear end of the push cap 29, the pusher rod 6 and the push cap 29 are moved together to advance the ink cartridge 10 and the slidable tube 27 at the same time. The writing instrument of the third embodiment can thus operate in substantially the same manner as those of the writing instruments according to the first and second embodiments.

Figure 9:
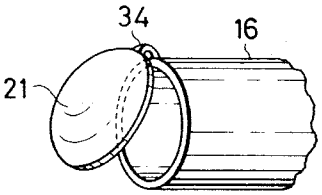
FIG. 9 is a fragmentary perspective view of a fourth embodiment.

FIG. 9 illustrates a fourth embodiment of the present invention. A sealing body 21 is integrally molded with the distal end of the inner tube 16 through an integral hinge 34.

Figure 11:
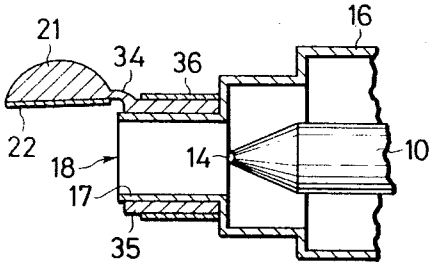
FIG. 11 is a fragmentary cross-sectional view of the fifth embodiment.
Figure 10:
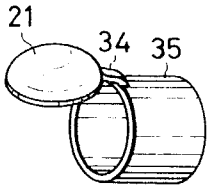
FIG. 10 is a fragmentary perspective view of a fifth embodiment.

According to a fifth embodiment shown in FIGS. 10 and 11, a sealing body 21 and a ring 35 are integrally molded of a resilient material through an integral hinge 34, and the ring 35 is fitted over the smaller-diameter portion of the inner tube 16 and attached in position by a retaining ring 36 fitted over the ring 35.

Figure 12:
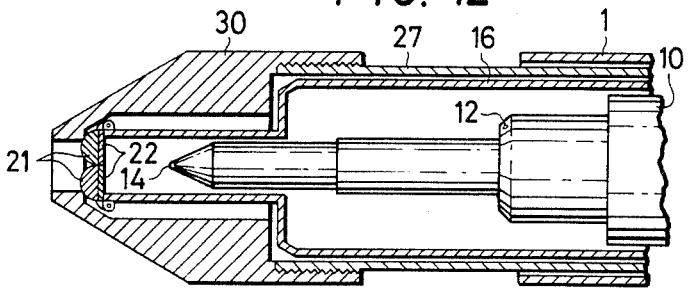
FIGS. 12 and 13 are fragmentary cross-sectional views of a sixth embodiment, showing steps of operation.
Figure 13:
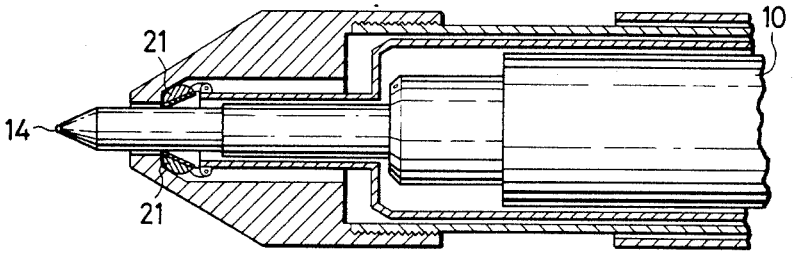

FIGS. 12 and 13 show a writing instrument constructed according to a sixth embodiment of the present invention. With the sixth embodiment, a pair of sealing bodies 21 is hinged to the distal end of the inner tube 16 and can swing open away from each other.

Figure 14:
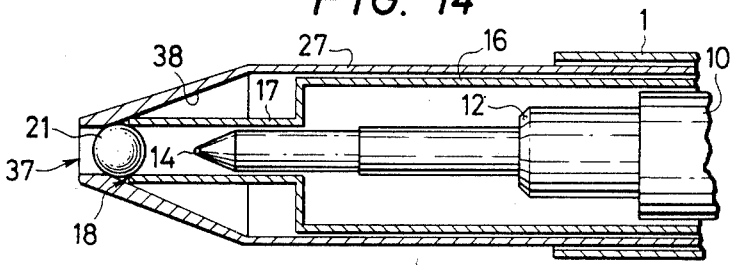
FIGS. 14, 15, 16 and 17 are fragmentary cross-sectional views of a seventh embodiment, showing steps of operation.
Figure 15:
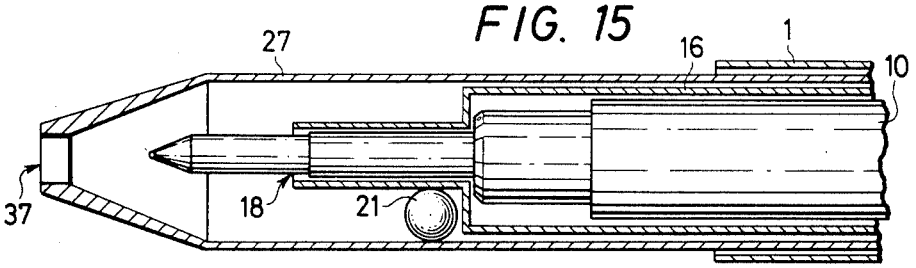
Figure 16:
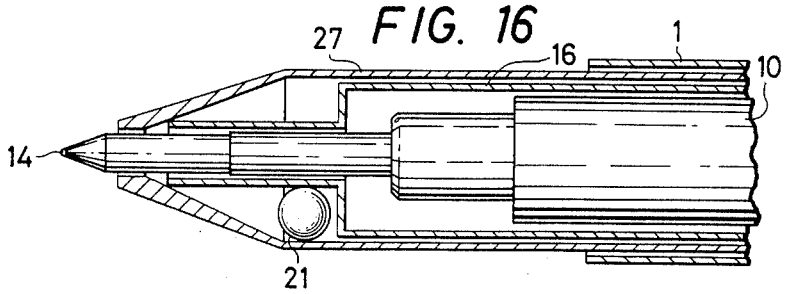
Figure 17:
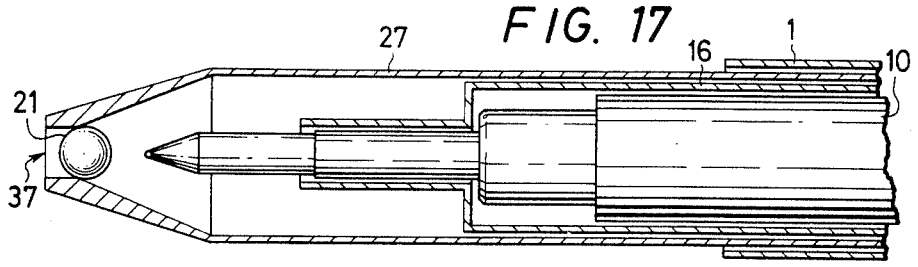

According to a seventh embodiment illustrated in FIGS. 14 through 17, a spherical sealing body 21 is employed instead of the disk-shaped sealing body 21. The slidable tube 27 is tapered at its distal end and has an opening 37 defined in the tapered end, the tapered end having an inner inclined surface 38. Therefore, no conical front piece 30 is mounted on the slidable tube 27. The sealing body 21 is slighly greater than the opening 37 in the slidable tube 27 and the opening 18 in the inner tube 16. In the sealed condition shown in FIg. 14, the sealing body 21 is clamped between the opening 37 in the slidable tube 27 and the opening 18 in the inner tube 16 to thereby close the opening 18 for sealing the writing tip 14. When it is desired to unseal the writing tip 10, the push cap is pushed while the writing instrument is held substantially horizontally or the tip end thereof is slightly raised. As the slidable tube 27 is advanced, the sealing body 21 drops out of engagement with the slidable tube 27 and the inner tube 16 and is brought off the opening 37 in the slidable tube 27 into the position of FIG. 16. The push cap is then released to keep the writing instrument in the writing position shown in FIG. 16. For sealing the writing tip 14 again, the push cap is depressed while the writing tip 14 is being directed downwardly. The slidable tube 27 now advances to allow the sealing body 21 to close the opening 37 in the slidable tube 27 as shown in FIG. 17. Thereafter, the push cap is free to bring the writing instrument back into the sealed condition as illustrated in FIG. 14.

Figure 18:
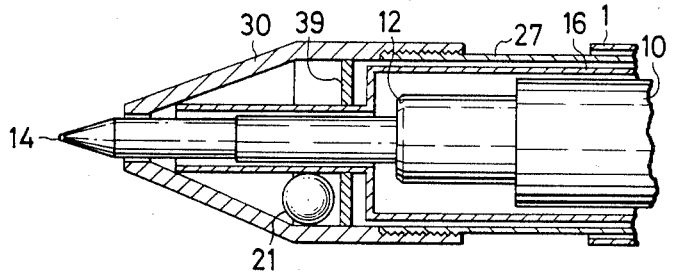
FIGS. 18, 19 and 20 are fragmentary cross-sectional views of eighth, ninth and tenth embodiments, respectively.

An eighth embodiment of the present invention will now be described with reference to FIG. 18. The writing instrument of the eighth embodiment is a small modification of that of the seventh embodiment. A conical front cap 30 threaded over the slidable tube 27 and has a disk-shaped flange 39 secured therein for accommodating a spherical sealing body 21 in the conical front cap 30. This arrangement makes it difficult for the sealing body 21 to drop off when the conical front cap 30 is removed for the replacement of the ink cartridge 10.

Figure 19:
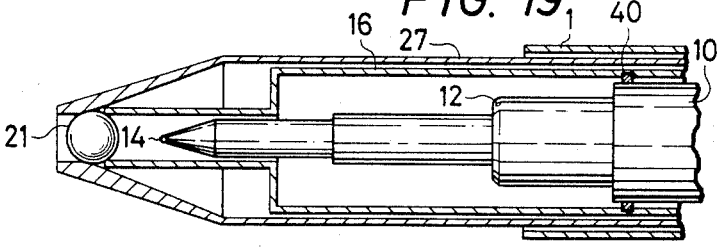

FIG. 19 illustrates a writing instrument according to a ninth embodiment of the invention. In the first embodiment, the rear end portion of the ink cartridge 10 is sealed in the vicinity of the rear end thereof. According to the ninth embodiment, a seal ring 40 is retained by an inner peripheral surface of the inner tube 16 to seal a portion of the ink cartridge 10 behind the air vent hole 12. The air vent hole 12 in the ink cartridge 10 may be located anywhere forward of the seal ring 40 in the sealed condition shown in FIG. 19. The seal ring 40 may be mounted on an outer peripheral surface of the ink cartridge 10.

Figure 20:
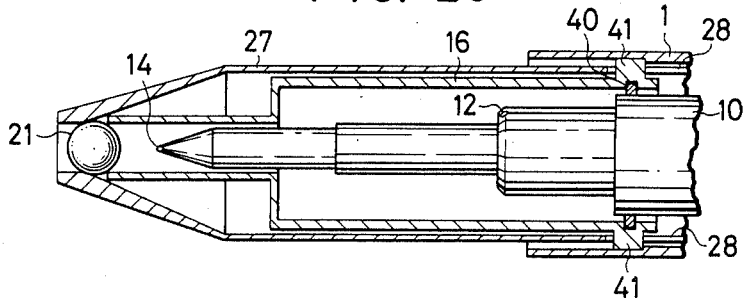
Figure 21:
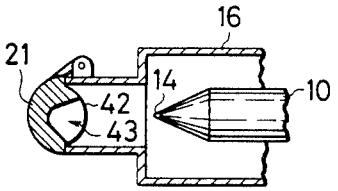
FIGS. 21, 23 and 24 are fragmentary cross-sectional views of an eleventh embodiment, showing steps of operation.
Figure 22:
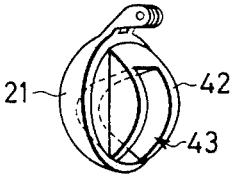
FIG. 22 is a fragmentary perspective view of the eleventh embodiment.

FIG. 20 illustrates a tenth embodiment of the present invention. While in the ninth embodiment the elongated inner tube 16 is employed, an inner tube 16 according to the tenth embodiment is comparatively short. The inner tube 16 has a pair of legs 41, 41 on an outer peripheral surface adjacent to a rear end thereof, the legs 41, 41 projecting outwardly through the slits 28, 28 in the slidable tube 27. The legs 41, 41 have outer ends fitted respectively in front grooves defined in an inner surface of the barrel 1. A seal ring 40 is retained by an inner surface of the inner tube 16 in the vicinity of a rear end thereof. The seal ring 40 may be mounted on an outer periphery of the ink cartridge 10 in contact with an inner periphery of the short inner tube 16.

Figure 23:
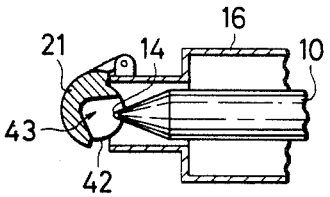
Figure 24:
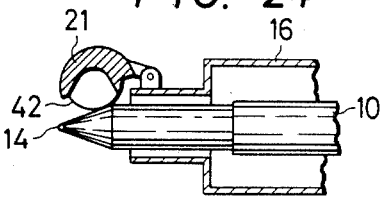

An eleventh embodiment of the invention will be described with reference to FIGS. 21 through 24. As better shown in FIG. 22, a sealing body 21 according to the eleventh embodiment has a round portion 42 projecting rearward and including a recess 43 defined in a rear surface thereof. The sealing body 21 has an outer periphery which can be held in intimate contact with the front edge of the inner tube 16. As illustrated in FIGS. 23 and 24, as the ink cartridge 10 advances, it fits in the recess 43 and lifts the sealing body 21 while the inclined surface of the distal end portion of the ink cartridge 10 is in contact with shoulders of the recess 43. Where no spring is used to normally urge the sealing body 21 in an opening direction, or the seal body 21 is normally urged to close the opening 18 in the inner tube 16, the writing tip 14 is protected from direct contact with the sealing body 21 when the inclined surface of the distal end portion of the ink cartridge 10 pushes the sealing body 21 aside. Therefore, there is no tendency of the sealing body 21 to get smeared with ink from the writing tip 14 or the writing tip 14 to be damaged from contact with the sealing body 21.

Figure 25:
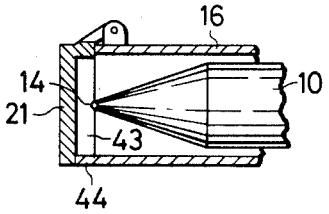
FIG. 25 is a fragmentary cross-sectional view of a twelfth embodiment.
Figure 26:
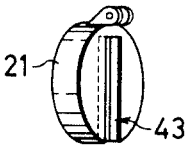
FIGS. 26 and 27 are fragmentary perspective views of the twelfth embodiment.
Figure 27:
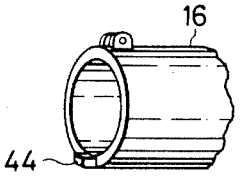

FIGS. 25 through 27 are illustrative of a twelfth embodiment of the present invention. A sealing body 21 according to the twelfth embodiment has a flat and straight recess 43 formed in a rear surface thereof, as better shown in FIG. 26. As illustrated in FIG. 27, the distal end of the inner tube 16 has a projection 44 sized to snugly fit in the recess 43. The operation and advantages of the writing instrument according to the twelfth embodiment can readily be understood from the description of eleventh embodiment and FIG. 25.

Figure 28:
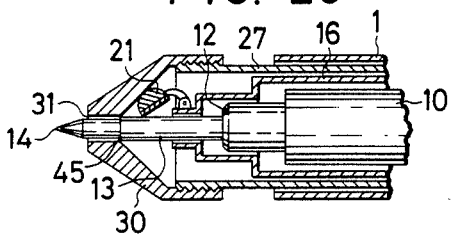

A thirteenth embodiment of the invention will be described with reference to FIG. 28. In the first embodiment, the conical front cap 30 is held against the sealing body 21 which is in contact with the ink cartridge 10 in the writing condition. Thus, the slidable tube 27 is prevented from moving back by the ink cartridge 10 through the sealing body 21. With the thirteenth embodiment, the opening 31 of the conical front cap 30 has an inner edge held against a step 45 on the smaller-diameter portion 13 of the ink cartridge 10, so that the slidable tube 27 is prevented from moving back directly by the ink cartridge 10.

Figure 29:
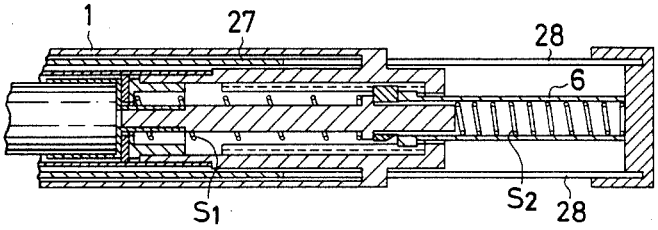

FIG. 29 shows a writing instrument according to a fourteenth embodiment of the present invention. In the second embodiment, the spring $S_2$ for urging the slidable tube 27 rearward can be seen through the slits 28, 28 in the slidable tube 27. According to the fourteenth embodiment, however, the spring $S_2$ is accommodated within the pusher rod 6 and cannot be seen from the exterior.

Figure 30:
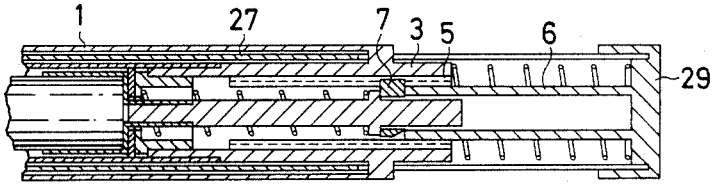

According to a fifteenth embodiment illustrated in FIG. 30, a pusher rod 6 and a push cap 29 are integrally molded. The cam wall 5 of the cylinder 3 extends to the rear end thereof so that the rotary cam 7 can be inserted into the cylinder 3 from the rear end thereof at the time of assembly.

Figure 31:
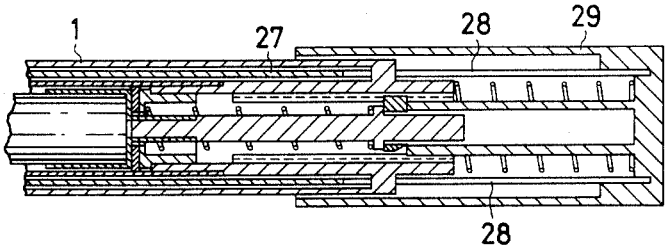

A sixteenth embodiment of the invention will be described with reference to FIG. 31. A push cap 29 is elongated to the extent that it entirely conceals the slits 28, 28 in the slidable tube 27.

Figure 7A:
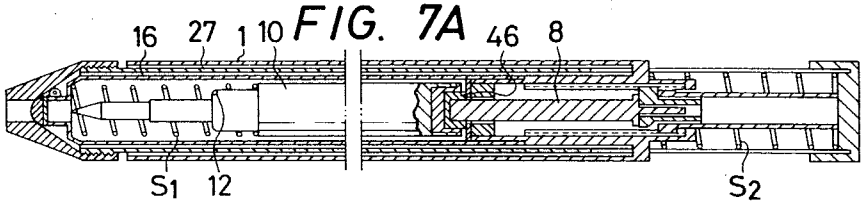
FIGS. 28, 29, 30, 31 and 7A are fragmentary cross-sectional views of thirteenth, fourteenth, fifteenth, sixteenth and seventeenth embodiments.

FIG. 7A shows a writing instrument according to a seventeenth embodiment of the present invention. The spring $S_2$ for urging the ink cartridge 10 backward is disposed between a step of the inner tube 16 near its front end and a step of the ink cartridge 10 near its front end. The ink cartridge 10 has in its rear end a recess in which there is fitted an attachment 46 fitted over the front end of the rod 8. Thus, the ink cartridge 10 is removably attached by the attachment 46 to the front end of the rod 8.

Figure 7B:
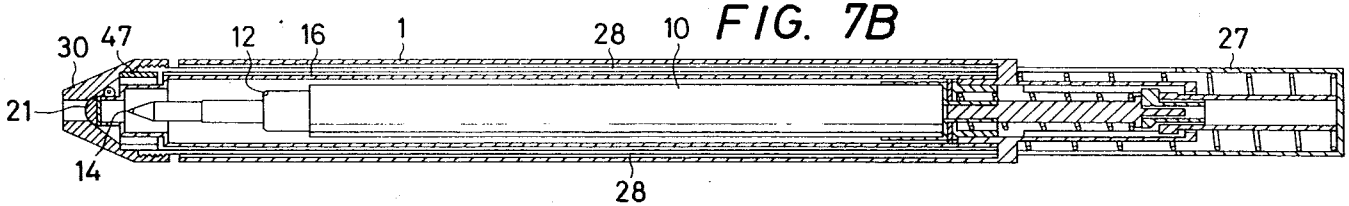
FIG. 7B is a cross-sectional view of an eighteenth embodiment of the present invention.

FIG. 7B illustrates a writing instrument according to an eighteenth embodiment of the present invention. The slidable tube 27 has long slits 28, 28 extending from the front end thereof so that the slidable tube 27 is inserted into the barrel 1 from the rear end thereof at the time of assembly. A ring 47 is fitted in the front end of the slidable tube 27 to reinforce the latter. The ring 47 may be fitted in the conical front cap 30 to provide reinforcement against radially inward bending of the slidable tube 27.

Although various embodiments of the present invention have been illustrated, the present invention is not limited to the foregoing embodiment only. For example, the invention is applicable to rotary type writing instruments. While the ink cartridge 10 can be locked in the advanced position or moved back to the retracted position by the cam mechanism disposed between the barrel 1 and the ink cartridge 10, the ink cartridge 10 may similarly be actuated by a screw-driven feed mechanism. In the first and other embodiments, the rear seal is provided by the packing 15. However, bushing 9 may be constructed of a resilient material to provide a desired seal rather than using the packing 15. In the first and other embodiments, furthermore, the seal member 22 is attached to the rear surface of the sealing body 21. However, the sealing body 21 itself may be made of a resilient material so that the seal member 22 may be dispensed with. Instead of employing the seal member 22, a seal ring or the like made of a resilient material may be attached to the distal end of the inner tube 16, or the inner tube 16 itself may be formed of a resilient material. Where the sealing body 21 is spherical in shape, it may be made of a resilient material. Where the distal end of the slidable tube 27 is rendered transparent, it allows visual inspection of movements of the internal mechanism.

With the writing instrument of the invention, as described above, the slidable tube 27 and the ink cartridge 10 should be moved forward to bring the writing instrument from the sealed condition into the writing condition. When the slidable tube 27 is moved forward, the sealing body 21 that has closed the opening 18 in the inner tube 16 is no longer pressed and the ink cartridge 10 is advanced until the writing tip 14 is projected out of the opening 28 in the inner tube 16. When the slidable tube 27 is thereafter retracted, the writing tip 14 projects through the distal end of the slidable tube 27, whereupon the writing instrument is in the writing condition. When the ink cartridge 10 is unlocked from the advanced position, the ink cartridge 10 is moved back into the inner tube 16, and the inner surface of the front end of the slidable tube 27 as it returns presses the sealing body 21 into the opening 18 in the inner tube 16, thus closing and sealing the opening 18. Since there is a seal means for providing a seal between the ink cartridge 10 and the inner tube 16 behind the opening 18, the writing tip 14 and the air vent hole 12 are both sealed at the same time. The writing instrument can be brought from the writing condition to the sealed condition or vice versa simply by advancing and retracting the slidable tube 27 and the ink cartridge 10. Therefore, the entire operation is quite simple. The seal in the sealed condition is provided between the position of the opening 18 in the inner tube 16 and the intermediate or rear position of the ink cartridge 10. This makes it possible to utilize commercially available ink cartridges 10 or small modifications thereof. When the ink cartridge 10 runs short of ink, it can simply be replaced with a new one.

The foregoing embodiments have various advantages but have some disadvantages. That is, as clearly shown in FIG. 1, there is always an annular concave step between the front end of the barrel 1 and the rear end of the conical member 1, which would adversely affect the aesthetic design of the writing instrument and would degrade its writing feeling because the writer's fingers would contact the annular concave step. The following embodiments remedy this disadvantage and more over provide a floating type writing instrument in which the writing tip may be slightly retracted in a writing state when an excessive writing pressure is applied thereto. The embodiments will now be described in detail.

Figures 32, 34, 35, 36:
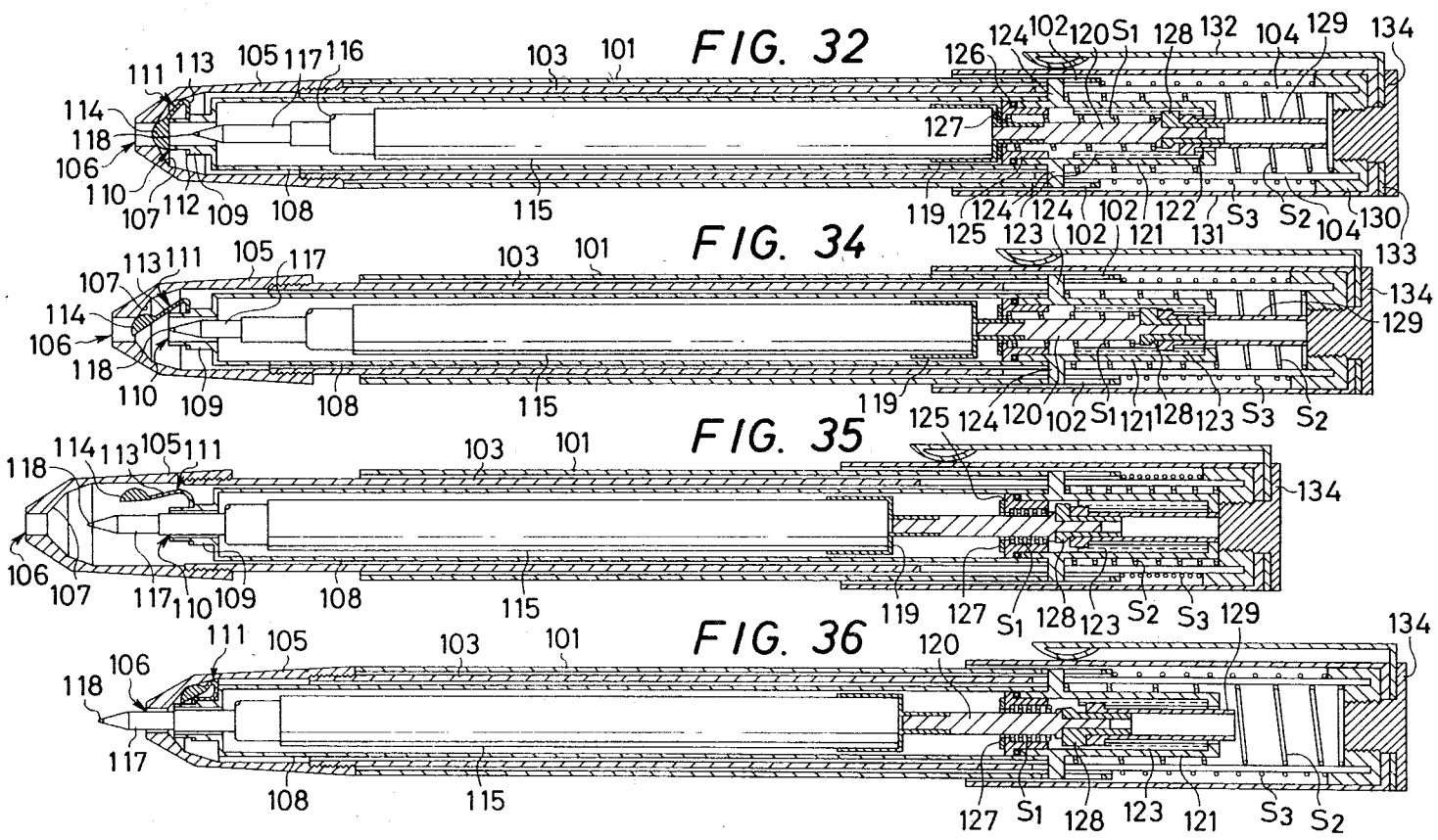
FIGS. 32, 34, 35 and 36 are cross-sectional views of a nineteenth embodiment.

FIG. 32 is a cross-sectional view of a writing instrument according to a nineteenth embodiment of the present invention. The writing instrument comprises a cylindrical barrel or casing 101 having a pair of axial slits 102, 102 formed in a rear end portion thereof in diametrically opposite relation. A slidable tube 103 is fitted in the barrel 101 for back-and-forth sliding movement therein. The slidable tube 103 also has a pair of axial slits 104, 104 formed in a rear end portion in diametrically opposite relation. A conical front cap 105 is threaded over a front end of the slidable tube 103. The conical front cap 105 is tapered at its front end with an opening 106 defined in a distal end thereof, and has an inner inclined surface 107.

Figure 33:
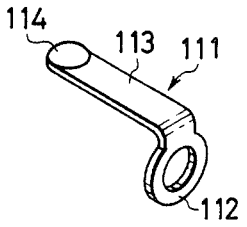
FIG. 33 is a perspective view of a seal body used in the nineteenth embodiment.

An inner tube 108 is fitted in the conical front cap 105 and the slidable tube for back-and-forth sliding movement therein. The inner tube 108 has a smaller-diameter front end portion 109 including an intermediate step and an opening 110 defined in a distal end thereof. A separate sealing body 111 as shown in FIG. 33 is made of a resilient material such as rubber. The sealing body 111 includes a ring-shaped attachment 112 and an L-shaped tongue 113 extending therefrom, the L-shaped tongue 113 having a seal member 114 at a distal end thereof. The seal member 114 has a hemispherical upper surface and a flat lower surface. For attachment, the attachment 112 is fitted onto the small-diameter portion 109 of the inner tube 108 and held against the step on the small-diameter portion 109. The attachment 112 may be bonded or simply left fitted over the small-diameter portion 109.

A writing member 115 such as an ink cartridge is fitted in the inner tube 108. The ink cartridge 115 has a front air vent hole 116 and includes a front smaller-diameter portion 117 having a writing tip 118 on a distal end thereof. Some writing instruments, however, do not require such an air vent hole 116. A separate connector 119 is composed of a front larger-diameter cylindrical portion and a rear smaller-diameter cylindrical portion. A rear end portion of the ink cartridge 115 is removably fitted in the front larger-diameter cylindrical portion. The rear smaller-diameter cylindrical portion is fitted over a front end portion of a rod 120. Thus, the rod 120 is connected to the rear end of the ink cartridge 115.

A cylinder 121 is fitted in a rear end of the inner tube 108, and has a rear end including a radically inward edge which provide a step 122. The cylinder 121 has an inner peripheral surface serving as a cam wall 123 having axial grooves and a front inclined locking edge. The cylinder 121 also has a pair of diametrically opposite legs 124, 124 projecting radially outwardly and fitted in the slits 104, 104 in the slidable tube 103 and the slits 102, 102 in the barrel 101.

A bushing 125 is fitted in the rear end of the inner tube 108 and the front end of the cylinder 121, with a seal ring 126 interposed between the bushing 125 and the cylinder 121. Another seal ring 127 is bonded to a front surface of the bushing 125.

A spring $S_1$ is disposed between a step formed on an inner surface of the bushing 125 and a step formed on an outer peripheral surface of the rod 120 near its rear end, and normally biases the rod 120 and the ink cartridge 115 to move in the rearward direction. A rotary cam 128 has a central hole in which there is fitted a smaller-diameter rear end portion of the rod 120. The rotary cam 128 is fitted in the cam surface 123 of the cylinder 121. The rotary cam 128 has on its outer periphery ridges fitted respectively in grooves in the cam wall 123. The rotary cam 128 has a rear inclined surface.

A pusher rod 129 is disposed behind the rotary cam 128. The pusher rod 129 is tubular in shape with a rear end portion of the rotary cam 128 fitted in a front end portion of the pusher rod 129. The front end portion of the pusher rod 129 has a larger front end engageable with the step 122 of the cylinder 121 to prevent the pusher rod 129 from being pulled rearwardly out of the cylinder 121. The larger front end of the pusher rod 129 has ridges fitted respectively in the grooves in the cam wall 123. The pusher rod 129 has a front inclined surface. The substantial portion of the pusher rod 129 projects rearwardly out of a rear opening in the cylinder 121.

A bearing ring 130 is fitted over the rear end of the slidable tube 103. A spring $S_2$ is interposed between the legs 124, 124 of the cylinder 121 and the bearing ring 130, and a spring $S_3$ is interposed between the rear end of the barrel 101 and the bearing ring 130. The bearing ring 130 has a central circular hole which is internally threaded. A cap 131 is fitted over the bearing ring 130 and the rear end portion of the barrel 101. For assembly, an attachment ring 133 of a clip 132 is held against a rear surface of the cap 131, and then an externally threaded central projection of a disk-shaped push member 134 is threaded into the internally threaded hole in the bearing ring 130 through central holes in the attachment ring 133 and the cap 131. The cap 131 and the clip 132 are now attached to the bearing ring 130.

FIG. 32 shows the writing instrument in a sealed condition. Since the slidable tube 103 and the conical front cap 105 are urged to move rearward under the force of the spring $S_2$ acting between the legs 124, 124 and the bearing ring 130, the hemispherical upper surface of the seal member 114 of the sealing body 111 with its attachment 112 mounted on the smaller-diameter portion 109 of the inner tube 108 is pressed by the inner inclined surface 107 of the conical front cap 105, thus preventing the conical front cap 105 and the slidable tube 103 from being retracted. The opening 110 in the inner tube 108 is completely sealed by the seal member 114. At this time, the barrel 101 is urged forward under the force from the spring $S_3$ acting between the rear end of the barrel 101 and the bearing ring 130, so that the front end of the barrel 101 is kept in intimate contact with the rear end of the conical front cap 105. The spring $S_3$ is much weaker than the force of the spring $S_2$. The spring $S_3$ may be dispensed with. In the rear portion of the writing instrument, the seal ring 127 bonded to the front surface of the bushing 125 provides a seal between the latter and the connector 119 attached to the rear end of the ink cartridge 115, and the seal ring 126 provides a seal between the bushing 125 and the cylinder 121. Accordingly, the ink cartridge 115 is completely sealed. In the sealed position, the pusher rod 129 is retracted back, and the rotary cam 128 is also retracted back in the cam wall 123.

To bring the writing instrument from the sealed condition into a writing condition, the barrel 101 is gripped and the push member 134 is pushed. When the push member 134 is pushed, the slidable tube 103 and the conical front cap 105 are slightly moved forward while compressing the springs $S_2$, $S_3$. After the front surface of the push member 134 hits the rear end of the pusher rod 129, the push member 134 causes the pusher rod 129, the rotary cam 128, the rod 120 and the connector 119 to advance the ink cartridge 115. The inner tube 108 is slightly advanced under the force of the spring $S_2$ acting on the legs 124, 124, and then is prevented from moving forward after the legs 124, 124 have reached the front edges of the slits 102, 102 in the barrel 101. As the conical front member 105, the slidable tube 103 and the ink cartridge 115 move further forward, the front end of the inner surface of the conical front cap 105 is spaced from the front end of the inner tube 108. At this time, the sealing body 111 springs forward under its own resiliency to open the opening 110 in the smaller-diameter portion 109 of the inner tube 108 as shown in FIG. 34. As the push member 134 is continuously pushed, the smaller-diameter portion 117 of the ink cartridge 115 projects through the opening 110 in the inner tube 108 as illustrated in FIG. 35. During movement from the position of FIG. 32 to the position of FIG. 35 through the position of FIG. 34, the writing tip 118 of the ink cartridge 115 does not contact the seal member 114. In the position of FIG. 35, the rotary cam 128 is positioned slightly forward of the front edge of the cam wall 123 while keeping the spring $S_1$ under compression. When the push member 134 is released of a push, the conical front cap 105 and the slidable tube 103 are retracted under the bias of the spring $S_2$. The ink cartridge 115 is prevented from moving back when the rotary cam 128 is pushed back by the spring $S_1$ and slightly turned to engage the front edge of the cam wall 123. Therefore, the distal end portion of the ink cartridge 115, including the writing tip 118, remains projecting out of the opening 106 of the conical front cap 105. The writing instrument is now in the writing position as shown in FIG. 36. At this time, the inner surface of the front end portion of the conical front cap 105 is kept in abutment against the front end of the inner tube 108, so that the conical front cap 105 and the slidable tube 103 are prevented from being retracted. There is no gap between the conical front cap 105 and the barrel 101 under the force of the spring $S_3$ as in the condition shown in FIG. 32. The writing instrument is now in readiness for writing operation.

In the writing condition, writing pressure acting on the ink cartridge 115 is borne by the spring $S_2$ through the rod 120, the rotary cam 128, the pusher rod 129, and the cylinder 121. Since any excessive writing force imposed on the ink cartridge 115 is taken up by the spring $S_2$, the writing tip 118 is prevented from being damaged due to such an excessive writing force.

To bring the writing instrument from the writing condition back into the sealed condition, the push member 134 is pushed in the position of FIG. 36. The push member 134 is advanced to hit the pusher rod 129 and move the rotary cam 128 slightly forward. When the rotary cam 128 is advanced slightly off the front edge of the cam wall 123 as shown in FIG. 35, the push member 134 is released. Then, the rotary cam 128 is slightly turned and thereafter retracted along the cam wall 123 under the force of the spring $S_1$. The ink cartridge 115 is also retracted until the rear end of the connector 119 abuts against the seal ring 127 in front of the bushing 125. By this time, the ink cartridge 115 is stored in the inner tube 108. The conical front cap 105 and the slidable tube 103 are also retracted under the force of the spring $S_2$. As the conical front cap 105 moves back, the seal member 114 of the sealing body 111 is progressively moved toward the opening 106 in the conical front cap 105 while the hemispherical upper surface of the seal member 114 is slid along the inner inclined surface 107 of the conical front cap 105, until the seal member 114 is eventually positioned behind the opening 106. Continued retraction of the conical front cap 105 causes the inner surface thereof to press the seal member 114 against the distal end of the inner tube 108, thus closing the opening 110 in the inner tube 108. The writing instrument is now brought back to the sealed condition as shown in FIG. 32.

The rear end of the conical front cap 105 and the front end of the barrel 101 are normally kept in close contact with each other with no gap left therebetween under the force of the spring $S_3$. This is to prevent an unsightly appearance which would otherwise be occasioned by such a gap, and prevent the barrel 1 from wobbling back and forth.

Figure 37:
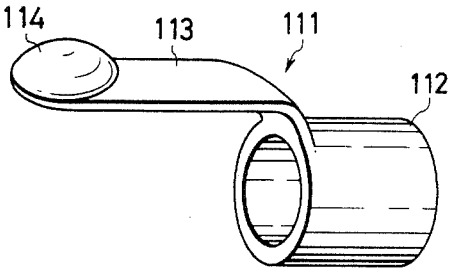
FIGS. 37 and 38 show a twentieth embodiment.
Figure 38:
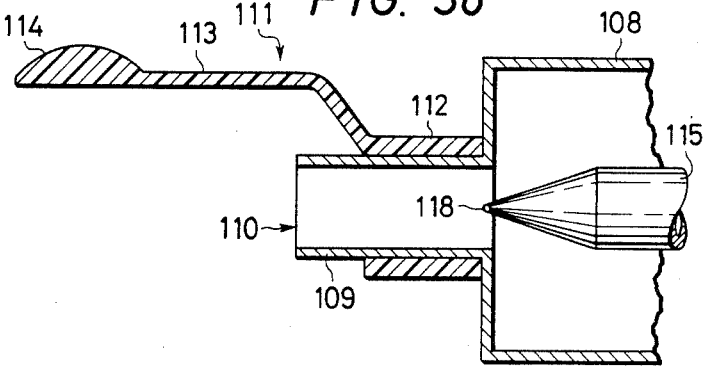

FIG. 37 shows a twentieth embodiment of the invention. In this embodiment, a cylindrical attachment 112 is made of elastic material and is to be press-fitted in the smaller-diameter portion 109 of the inner tube 108, as in FIG. 38, so that the attachment 112 may be held on the outer periphery of the inner tube 108 without adhesives.

Figure 39:
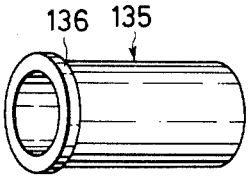
FIGS. 39 and 40 show a twenty-first embodiment.
Figure 40:
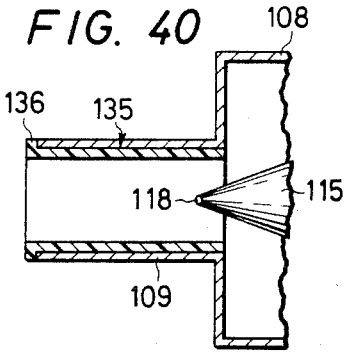

A twenty-first embodiment of the invention will now be described with reference to FIGS. 39 and 40. In this embodiment, a cylindrical member 135 made of elastic material is inserted into the smaller-diameter portion 109 of the inner tube 108 as shown in FIG. 39. The cylindrical member 135 has at its front end a radially outwardly extending flange 136 which is to be positioned at the front end of the smaller-diameter portion 109. With such an arrangement, it is possible to satisfactorily seal the interior of the inner tube 108 even if the seal member 114 of the seal member 111 is not made of elastic member.

Figure 41:
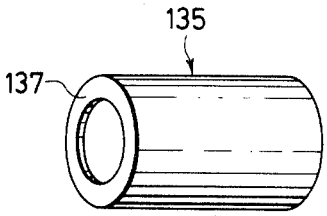
FIGS. 41 and 42 show a twenty-second embodiment.
Figure 42:
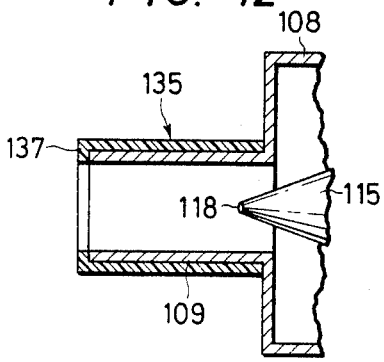

A twenty-second embodiment of the invention will now be described with reference to FIGS. 41 and 42 in which the cylindrical member 135 is fitted around the outer periphery of the inner tube 108 and has at its front end a radially inwardly extending flange 137 which is to be positioned at the front end of the smaller diameter portion 109. With such a construction, substantially the same effect as in the twenty-first embodiment may be obtained.

Figure 43:
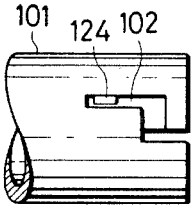
FIG. 43 shows a twenty-third embodiment.

A twenty-third embodiment of the invention will now be described with reference to FIG. 43. In the nineteenth embodiment, there is a fear that it would be somewhat difficult to insert the legs 124, 124 of the cylinder 121 into the slits 102, 102 of the barrel 101. In the twenty-third embodiment, the slits 102, 102 are formed in a curvilinear shape as shown in FIG. 43, so that in assembling, an additional step in which the barrel 101 and the cylinder 121 are rotated relative to each other is carried out. With such a construction, the barrel 101 may be prevented from being pulled apart from the mechanism.

While the invention has been described in detail and with reference to specific embodiments thereof, it will be apparent to one skilled in the art that various changes and modifications can be made therein without departing from the spirit and scope thereof.

What is claimed is:

1. A writing instrument comprising:

an outer barrel unit (1);

a slidable tube (27) housed in said outer barrel unit (1) and movable between a sealing position, and an advanced position;

an inner tube (16) housed in said slidable tube (27), said inner tube (16) having an opening (18) defined in a distal end thereof and being associated with said barrel unit (1);

a writing unit (10) disposed in said inner tube (16) and having a writing tip (14) on a distal end thereof, said writing unit being axially movable among a retracted position, a writing position and a projected position;

a first means for biasing said writing unit in one direction;

a second means for biasing said slidable tube in said one direction;

a first sealing means for sealing said opening (18) of said inner tube (16), said first sealing means being pressable by an inner surface of a front end of said slidable tube (27) against said opening (18) of said inner tube (16) when said slidable tube (27) is in said sealing position;

a second sealing means for sealing said writing tip (14) of said writing unit (10) together with said first sealing means, said second sealing means being located between said writing unit (10) and said inner tube (16) towards a proximal end of said inner tube (16); and a retaining means for retaining said writing unit (10) at said retracted position and said writing position.

2. The writing instrument of claim 1, wherein said slidable tube (27) is moved to advance said writing unit (10) simultaneously against biasing forces of said first and second biasing means.

3. The writing instrument of claim 1, further comprising means for moving said slidable tube (27) to advance said writing unit (10) with a predetermined delay against biasing forces of said first and second biasing means.

4. The writing instrument of claim 1, further including a third means for biasing said first sealing means in an opening direction.

5. The writing instrument of claim 1, said first sealing means including a disc-like sealing member made of elastic material.

6. The writing instrument of claim 1, said slidable tube (27) having an opening at its rear end, writing unit (10) having a pusher rod (6) at its rear end, said pusher rod (6) extending through said opening of said slidable tube.

7. The writing instrument of claim 1, said first sealing means including a sealing body (21) integrally formed with said inner tube (16).

8. The writing instrument of claim 1, said first sealing means including a sealing body (21) integrally formed with a ring member (35), said ring member being fittable on said inner tube (16).

9. The writing instrument of claim 1, said first sealing means including sealing body halves each hinged around said opening of said inner tube (16).

10. The writing instrument of claim 1, said first sealing means including a spherical member.

11. The writing instrument of claim 10, said slidable tube (27) having around its inner front surface a disc-shaped flange (39).

12. The writing instrument of claim 1, said first sealing means including a sealing body 21 having a round portion (42) and a recess (43) therein, said sealing body (21) being hinged at the inner tube (16), said recess having a width greater than a diameter of said writing tip of said writing unit.

13. The writing instrument of claim 12, said opening of said inner tube (16) having a projection (44) at a position opposite to the hinge of said sealing body (21), said projection being engageable with said recess.

14. The writing instrument of claim 1, wherein said slidable tube 27 is held at a step (45) formed on said writing unit (10) when said writing unit is in said writing position.

15. The writing instrument of claim 1, wherein said outer barrel unit (1) and said inner tube (16) are securely coupled to each other.

16. The writing instrument of claim 1, wherein said inner tube (108) and said outer barrel (101) are movable relative to each other.

17. The writing instrument of claim 16, further including a fourth means for biasing said inner tube (108) in a second direction opposite to said one direction.

18. The writing instrument of claim 17, said first sealing means including a seal member (114), an elongated tongue (113) and a ring-shaped attachment (112).

19. The writing instrument of claim 18, wherein said seal member (114), tongue member (113) and ring-shaped attachment (112) are formed of one piece of elastic material.

20. The writing instrument of claim 18, wherein a cylindrical member (135) made of elastic material and having a radially outwardly extending flange (136) is fitted in a front and inner surface of said inner tube (108).

21. The writing instrument of claim 18, wherein a cylindrical member (135) made of elastic material and having a radially inwardly extending flange (137) is fitted around in a front end outer surface of said inner tube (108).

* * * * *